United States Patent [19]

Tsukamoto et al.

[11] 3,951,029

[45] Apr. 20, 1976

[54] AUTOMATIC ACCOMPANIMENT SYSTEM FOR USE WITH AN ELECTRONIC MUSICAL INSTRUMENT

[75] Inventors: Masao Tsukamoto, Katano; Makito Kawai, Hirakata; Tomiji Munehiro, Neyagawa, all of Japan

[73] Assignee: Matsushita Electric Industrial Co., Ltd., Kadoma, Japan

[22] Filed: Aug. 13, 1974

[21] Appl. No.: 497,134

[30] Foreign Application Priority Data

Aug. 24, 1973 Japan ..... 48-94365
Aug. 24, 1973 Japan ..... 48-94366

[52] U.S. Cl. ..... 84/1.03; 84/DIG. 12
[51] Int. Cl.² ..... G10H 1/00; G10H 5/06
[58] Field of Search ..... 84/1.01, 1.03, 1.17, 84/1.24, DIG. 12, DIG. 22

[56] References Cited

UNITED STATES PATENTS

| | | | |
|---|---|---|---|
| 3,548,066 | 12/1970 | Freeman | 84/1.03 |
| 3,590,129 | 6/1971 | Freeman | 84/1.01 |
| 3,711,618 | 1/1973 | Freeman | 84/1.03 |
| 3,712,950 | 1/1973 | Freeman | 84/1.03 |
| 3,715,442 | 2/1973 | Freeman | 84/1.01 |
| 3,718,748 | 2/1973 | Bunger | 84/1.24 |
| 3,725,562 | 4/1973 | Munch, Jr. et al. | 84/1.24 |
| 3,825,667 | 7/1974 | Schrecongost | 84/1.01 |
| 3,839,592 | 10/1974 | Freeman | 84/1.01 |
| 3,842,184 | 10/1974 | Kniepkamp et al. | 84/1.01 |

*Primary Examiner*—L. T. Hix
*Assistant Examiner*—Stanley J. Witkowski
*Attorney, Agent, or Firm*—Wenderoth, Lind and Ponack

[57] ABSTRACT

An automatic accompaniment system for use with an electronic musical instrument of a type having keyboard arrangements, which is capable of automatically sounding chords and basses in accordance with a predetermined rhythm of a selected music, the basses of which are each formed by some of tones forming each chord in the case where the right and left hands of a player are used to play the melody and an accompaniment, respectively. To this end, the system includes a counting circuit composed of a binary counter and a decoder, a high frequency pulse generator, a plurality of logical gating elements and a rhythm pulse generator. While outputs from the counting circuit correspond to respective tones of keys on the keyboard arrangement, counting of the number of high frequency pulses from the high frequency pulse generator is performed and this counting operation is stopped by the gating elements, when the outputs from the counting circuit and component tones of a chord formed coincide with each other, thereby permitting passage of tone signals from tone signal sources through the gating elements. This cycle of operation is repeated each time rhythm pulses are applied.

9 Claims, 39 Drawing Figures

Figure 2:
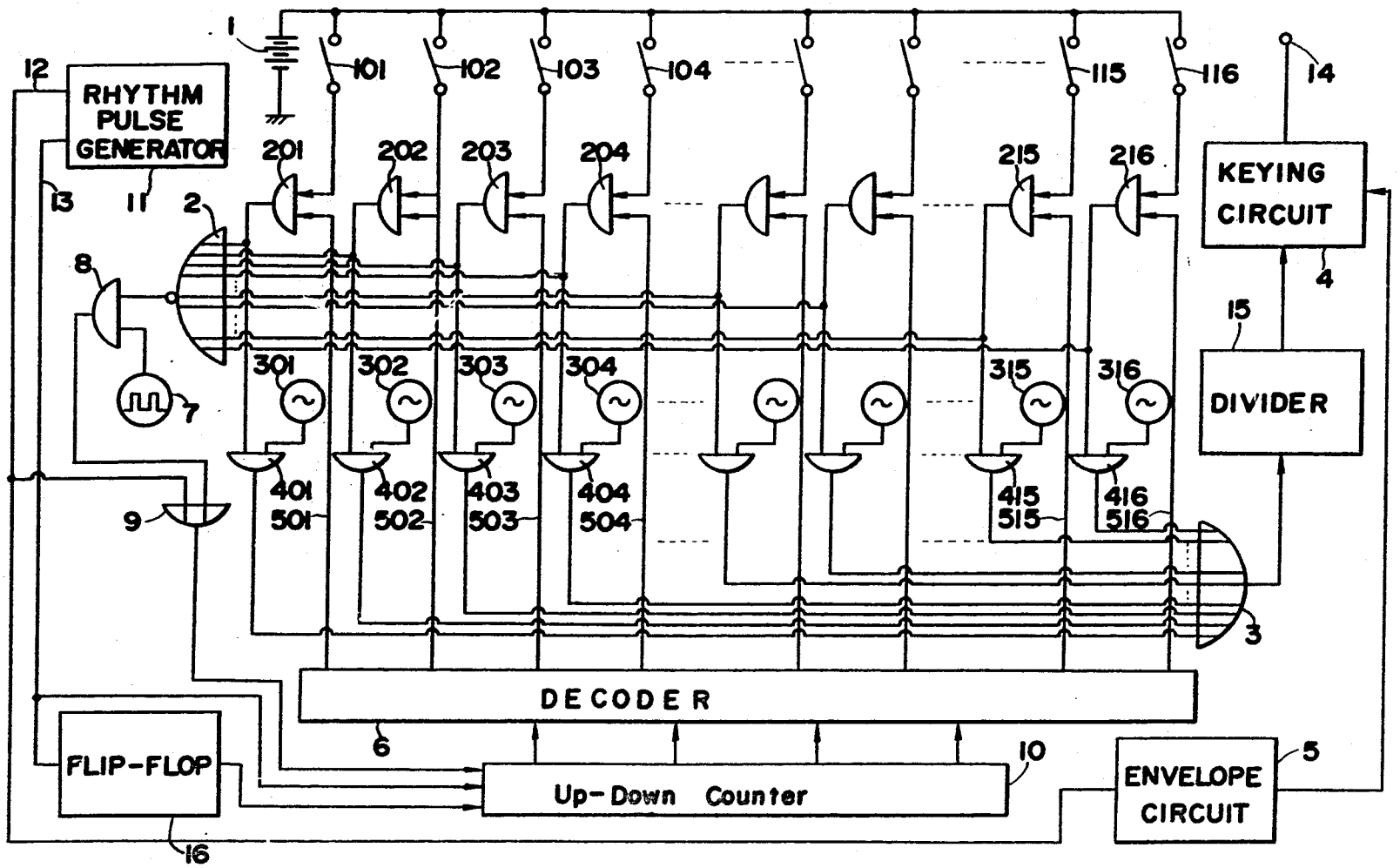

FIG. 1 (a)
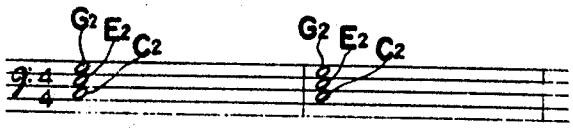
FIG. 1 (b)
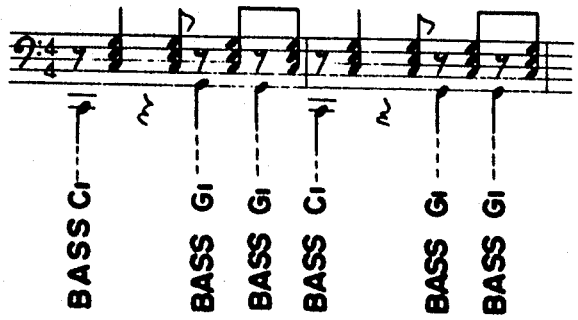
FIG. 3 (a)
FIG. 3 (b)
FIG. 3 (c)
FIG. 3 (d)
FIG. 3 (e)
FIG. 3 (f)
FIG. 3 (g)
FIG. 3 (h)
FIG. 3 (i)
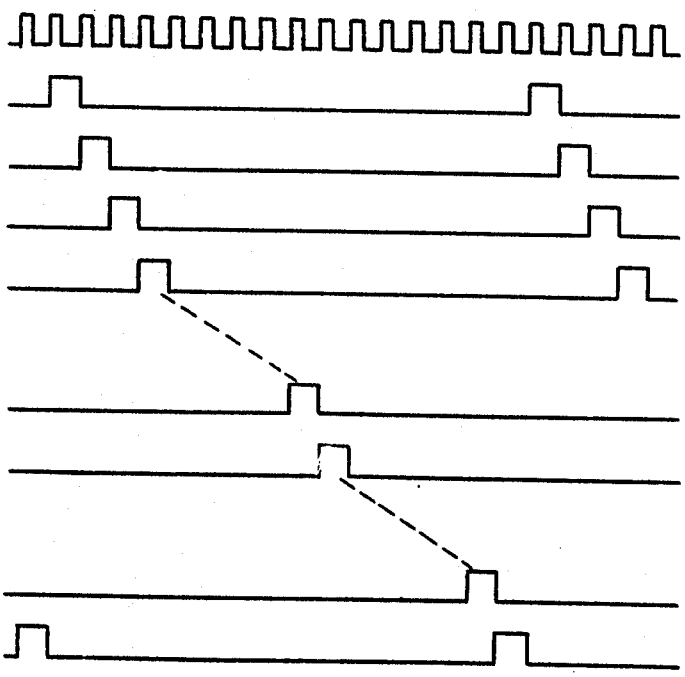

FIG. 4 (a)
FIG. 4 (b)
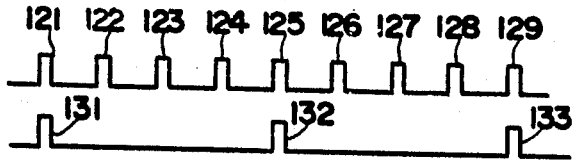
FIG. 4 (c)
FIG. 4 (d)
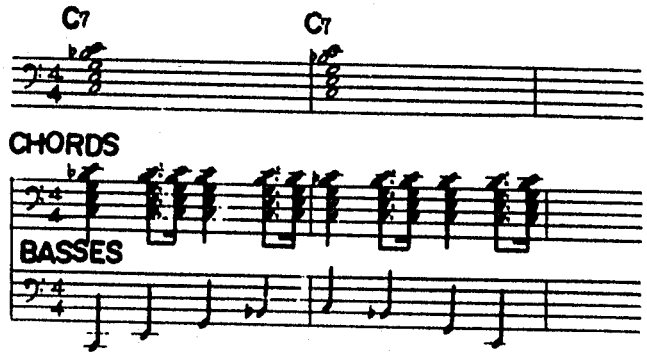
FIG. 7 (a)
FIG. 7 (b)
FIG. 7 (c)
FIG. 7 (d)
FIG. 7 (e)
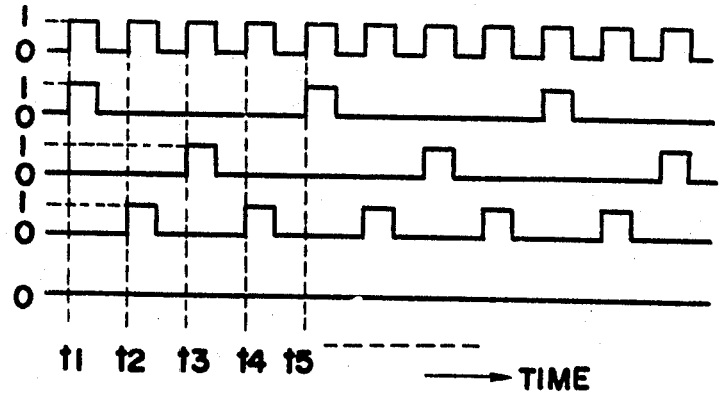
FIG. 7 (f)
FIG. 7 (g)
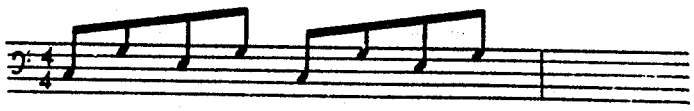

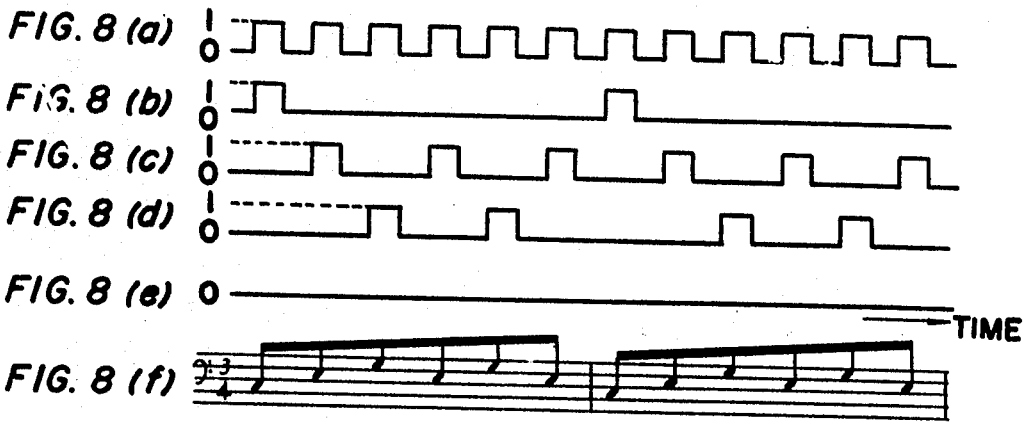
FIG. 8 (a)
FIG. 8 (b)
FIG. 8 (c)
FIG. 8 (d)
FIG. 8 (e)
TIME
FIG. 8 (f)
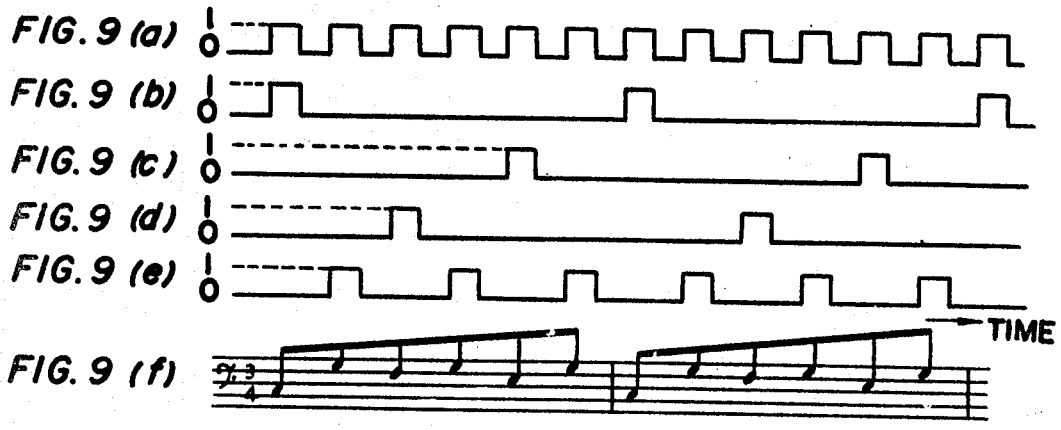
FIG. 9 (a)
FIG. 9 (b)
FIG. 9 (c)
FIG. 9 (d)
FIG. 9 (e)
TIME
FIG. 9 (f)

AUTOMATIC ACCOMPANIMENT SYSTEM FOR USE WITH AN ELECTRONIC MUSICAL INSTRUMENT

The present invention relates to an automatic accompaniment system for use with an electronic musical instrument, that is, an electronic organ.

When an electronic organ having upper and lower keyboard arrangements and pedal keys is to be played, the right and left hands of a player have heretofore been required to operate the upper and lower keyboard arrangement for playing a melody and an accompaniment, respectively, while feet are used to operate the pedal keys for forming a bass. This technique of playing the electronic organ is difficult for a beginner on the electronic organ to practise and an automatic accompaniment system according to the present invention is capable of automatically providing the accompaniment which has heretofore played by the left hand and feet of the player.

More particularly, the present invention pertains to an automatic accompaniment system capable of automatically playing an accompaniment in such a way as to perform chords, produced by depression of some of the keys operated by the left hand of a player in reference to a musical scale of, for example the waltz, bossanova or rumba while the right hand of the player is used to operate keys on the upper keyboard to play the rhythm, and a bass formed by the chords, without substantially requiring the player to use his feet to operate the pedal keys.

According to the prior art automatic accompaniment system, when a bass is to be formed by chords produced by depression of keys operated by the left hand of the player, detection has been made of the lowest tone of the chords or the highest tone of the chords and a divider circuit is utilized to produce a bass one or more octaves below these tones, these chords and the bass being played in accordance with a predetermined rhythm. By way of example, in the case where keys corresponding to $C_2$, $E_2$ and $G_2$ shown in FIG. 1(*a*) are continuously depressed, the lowest tone $C_2$ and the highest tone $G_2$ are respectively sampled out by a lowest note preference circuit and a highest note preference circuit and are in turn divided by the divider circuit to produce tones of $C_1$ and $G_1$ one octave below the lowest and highest tones, these chords and the resultant bass being played in accordance with the rhythm of, for example, a beguine, the result off accompaniment performed by the prior art accompaniment system being as shown in FIG. 1(*b*). It will be readily seen that the bass available in the prior art accompaniment system is that formed by the lowest tone $C_1$ and the highest tone $G_1$ of a chord produced by the left hand of the player and no bass formed by the other tones of the chord is utilized. Accordingly, a bass accompaniment which is a so-called walking bass wherein a bass figure varies with variation of the tones forming a chord cannot be performed by the conventional accompaniment system.

In a method of performing the walking bass heretofore proposed, there are provided AND gating elements corresponding in number to the number of chords. According to this method, when some of keys corresponding respectively to, for example, $C_2$, $E_2$ and $G_2$ are depressed, one of these gating elements which corresponds to a chord formed by these tones is operated thereby to cause basses of $G_1$, $E_1$ and $G_1$ in a sequential manner.

In practising the above described method, the number of the AND gating elements should be substantially equal to the number of chords and is, therefore, great. By way of example, in so far as chords of C which is most frequently used are concerned, nine chords such as Cmaj, Cm, $C_6$, $C_7$, $Cm_6$, $Cm_7$, Caug, Cdim and $C_6$ are used, and the same is equally applicable to individual chords of C #, D, B and the other eight tones. Therefore, 108 AND gating elements, that is, 9 × 12, are required and, if inversions of each of the chords are taken into consideration, 324 AND gating elements are required.

Moreover, it is well known that in order to form a chord, three or more keys are usually required to be depressed simultaneously. If two keys corresponding to $C_2$ and $E_2$ are simultaneously depressed, the resultant chord cannot be identified as being Cmaj, Am or $C_7$ and, if two keys corresponding to $C_2$ and $G_2$ are simultaneously depressed, the resultant chord cannot be identified as being Cmaj, Cm or $C_7$. Therefore, each of the AND gating elements should be of a type having three input terminals which means that simultaneous depression of two or less keys does not cause the relevant AND gating element to be operated and, consequently, an intended bass chord cannot be obtained.

As hereinbefore described, according to the proposed method, in view of the fact that each of the AND gating elements employed has the three input terminals, simultaneous depression of three or more keys corresponding to, for example, $C_2$, $E_2$ and $G_2$ causes one of the AND gating elements, which corresponds to a resultant chord Cmaj, to be operated so that the walking bass corresponding to $C_1$, $E_1$ and $G_1$ can be played. However, in the event that one of these keys corresponding to $C_2$, $E_2$ and $G_2$ is erroneously depressed, for example, if the key corresponding to $B_2$ is depressed in place of the key corresponding to $G_2$ during the simultaneous depression thereof, no AND gating element which corresponds to a relevant chord is available and, therefore, no bass is sounded.

In view of the fact described above, in order to practice the above described method, design has to be carried out in such a manner as to limit the number of chords available without taking the presence of inversions of each of the chords into consideration. This means that the electronic organ practicing the above described method has a reduced functional capability.

Accordingly, an essential object of the present invention is to provide an improved automatic accompaniment system for use with an electronic musical instrument, which is capable of automatically sounding a bass merely by depressing some of keys in the keyboard arrangement in accordance with designated chords, with substantial elimination of the disadvantage and inconveniences inherent in the prior art system of a similar kind.

Another object of the present invention is to provide an improved automatic accompaniment system of the type referred to above, which is capable of automatically sequentially varying basses merely by depressing some of the keys in the keyboard arrangement in accordance with the designated chords.

A further object of the present invention is to provide an improved automatic accompaniment system of the type referred to above, which is capable of automatically sequentially upwardly and downwardly varying basses merely by depressing some of the keys in the keyboard arrangement in accordance with the designated chords.

A still further object of the present invention is to provide an improved automatic accompaniment system of the type referred to above, which is also capable of automatically sounding a bass formed by the lowest and highest tones produced by two of the depressed keys.

A still further object of the present invention is to provide an improved automatic accompaniment system of the type referred to above, which is capable of automatically sounding a bass in a controlled manner merely by depressing some of keys in the keyboard arrangement in accordance with the designated chords.

Figure 5:
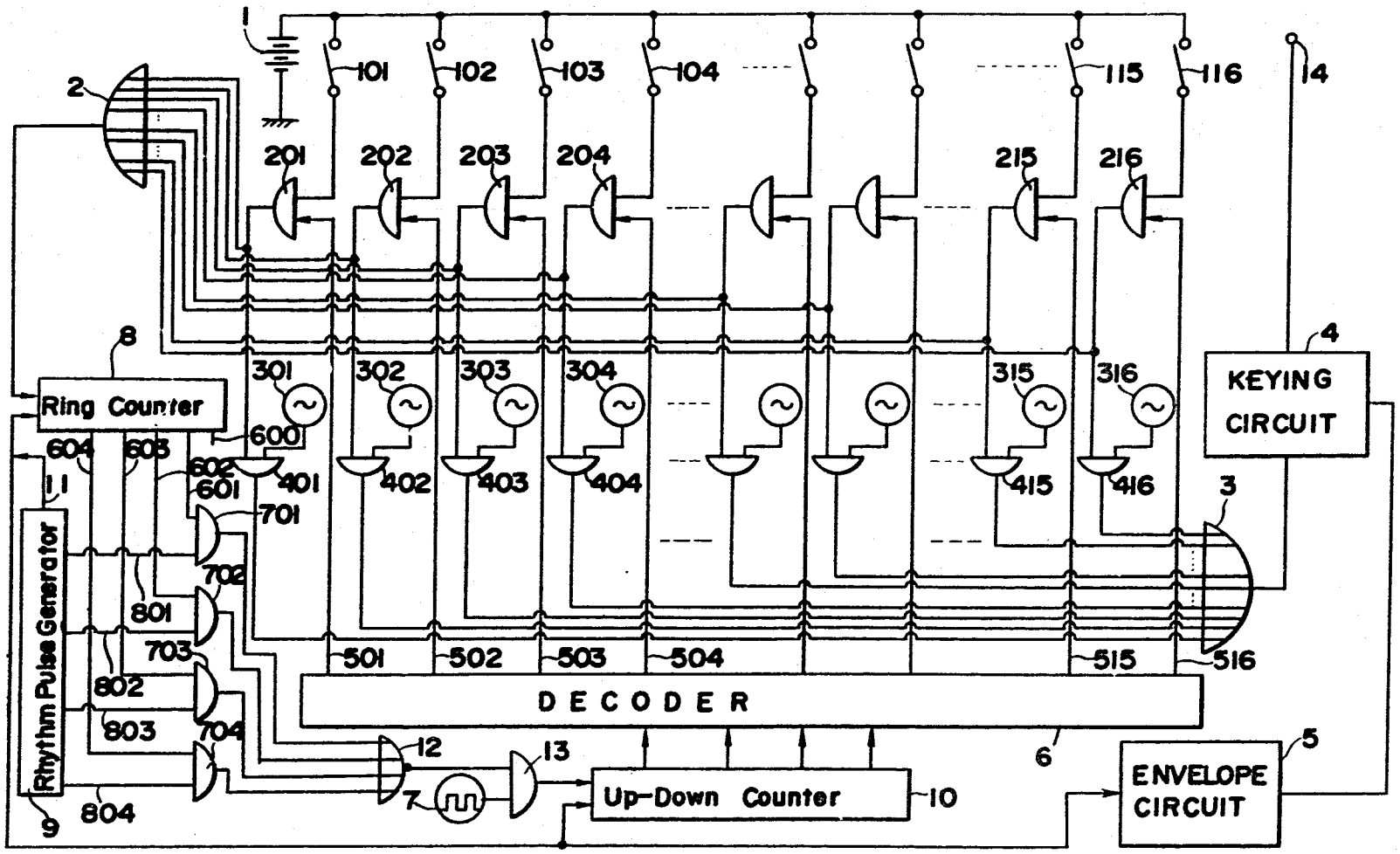
Figures 6A, 6B, 6C:
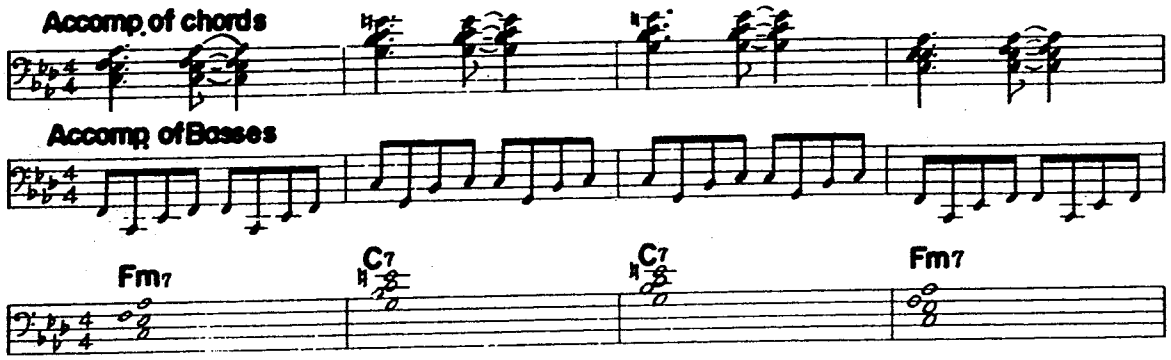

These and other objects and features of the present invention will become readily apparent from the following description taken in conjunction with preferred embodiments thereof with reference to the accompanying drawings, in which:

FIG. 1 is a diagram showing a portion of a musical scale, which is used to explain chords and basses played by the prior art automatic accompaniment system, FIG. 1(*b*) is a diagram showing a portion of a musical scale on the basis of which the chords and basses of FIG. 1(*a*) are produced, FIG. 2 is a block diagram showing an electric circuit used in the accompaniment system of the present invention according to one preferred embodiment thereof, FIG. 3(*a*) is a diagram of a waveform of a high frequency signal generated by a high frequency pulse generator employed in the circuit of FIG. 2, FIG. 3(*b*) to (i) are diagrams of waveform of pulses respectively generated from output lines of a decoder in sequential manner, which decoder is employed in the circuit of FIG. 2, FIG. 4(*a*) and (*b*) are diagrams of waveforms of respective pulses generated by a rhythm pulse generator in relation to each other, FIG. 4(*c*) is a diagram of a portion of a musical scale to be played by the use of the accompaniment system of the present invention, FIG. 4(*d*) is a diagram of a portion of a musical scale, which is used to explain chords and basses produced by the accompaniment system of the present invention by playing the musical scale of FIG. 4(*c*), FIG. 5 is a block diagram showing an electric circuit used in the system of the present invention according to another preferred embodiment thereof, FIGS. 6(*a*) and (*b*) are diagrams of portions of musical scales showing chords and basses produced by the system of the present invention according to another preferred embodiment thereof, FIG. 6(*c*) is a diagram of a portion of a musical scale, on the basis of which the chords and basses of FIG. 7(*b*) are produced by the system of FIG. 5, FIGS. 7(*a*) to (*e*) illustrate in a time chart various pulses appearing on output lines of a rhythm pulse generator shown in FIG. 5, FIGS. 7(*f*) and (*g*) respectively illustrate a portion of a musical scale and a musical scale of broken chords produced by the system of the present invention according to a further embodiment thereof on the basis of the musical scale of FIG. 7(*f*), FIGS. 8(*a*) to (*e*) illustrate in a time chart various pulses appearing on output lines of the rhythm pulse generator shown in FIG. 5, FIG. 8(*f*) illustrates a portion of a musical scale showing broken chords produced by the system of the present invention according to a further embodiment thereof, FIGS. 9(*a*) to (*e*) illustrate in a time chart various pulses appearing on the output lines of the rhythm pulse generator shown in FIG. 5, FIG. 9(*f*) illustrates a portion of a musical scale showing broken chords produced by the system of the present invention according to a further embodiment thereof, FIG. 10 is a block diagram showing an electric circuit used in the system of the present invention according to a still further embodiment thereof, and FIG. 11 is a diagram similar to FIG. 11, according to a still further embodiment of the present invention.

Before the description of the present invention proceeds, it should be noted that in all of the embodiments herein disclosed of the present invention an automatic accompaniment system for use with an electronic musical instrument or electronic organ will, for the sake of facilitating a better understanding of the present invention, be described as having a keyboard arrangement composed of sixteen keys.

Referring now to FIG. 2, a source of electric power 1 is, for the sake of brevity, shown in the form of a DC battery source having a negative terminal grounded and a positive terminal connected to one input terminal of each of AND gates 201, 202, 203, 204 . . . 215 and 216 through a corresponding one of key switches 101, 102, 103, 104 . . . 115 and 116. The key switches 101 to 116 are to be understood as operatively associated with respective keys, for example, lower manual (shown), in such a way that only when any of the keys note in the keyboard arrangement is depressed, corresponding key switches which are associated with the depressed keys are closed to complete an electric circuit between the power source 1 and the related AND gate.

Output terminals of the AND gates 201 and 216 are all connected in shunt to respective input terminals of a NOR gate 2 and to one input terminal of respective AND gates 401, 402, 403, 404 . . . 415 and 416, the other input terminals of these AND gates 410 to 416 being connected with respective sources of musical tones 301, 302, 303, 304 . . . 315 and 316.

Structural features of the individual tone sources 310 to 316 are well known to those skilled in the art and each is substantially composed of an oscillator which is continuously operated during energization of the electronic organ to produce a tone signal indicative of the tone of a depressed one of the keys in the keyboard arrangement.

Output terminals of the AND gates 401 to 416 are all connected to respective input terminals of an OR gate 3, the output terminal of which OR gate 3 is connected to an output terminal 14 through a divider 15 by means of a keying circuit 4.

A high frequency pulse generator 7 and the output terminal of the NOR gate 2 are connected to respective input terminals of an AND gate 8, the output terminal of which AND gate 8 is connected to one input terminal of an OR gate 9. The OR gate 9 has the output terminal connected to a count terminal of a 4-bit, binary Up-Down counter 10 which acts to count the number of pulses fed thereto from the high frequency pulse generator 7 through the AND gate 8 by means of the OR gate 9 so long as the AND gate 8 is triggered on and, simultaneously therewith, no signal is applied to the other input terminal of the OR gate 9.

A rhythm pulse generator 11 has a pair of output lines 12 and 13; the output line 12 being connected in shunt to the other input terminal of the OR gate 9 and to an envelope circuit 5 to operate the latter, said envelope circuit 5 when in operation generating a drive signal used to drive the keying circuit 4, and the other output line 13 being connected in shunt to a flip-flop circuit 16 and to a reset terminal of the Up-Down counter 10. The flip-flop circuit 16 is such that the state of an output signal to be applied therefrom to an up-down terminal of the Up-Down counter 10 is inverted each time one pulse is applied thereto from the rhythm pulse generator 11 through the output line 13.

The Up-Down counter 10 is connected to a decoder 6 which acts to decode or convert binary-coded, 4-bit pulses that have been fed thereto from the Up-Down counter 10 into hexadecimal-coded pulses, and has output lines 501, 502, 503, 504 . . . 515 and 516 which are respectively connected to individual other terminals of the AND gates 201 to 216.

In the arrangement as hereinbefore described, the system functions in such a manner as hereinafter described.

Assuming that the electronic organ is energized and no key is depressed, that is, no key switch 101 to 116 is closed, the counter undergoes a counting operation. More particularly, during the above mentioned condition wherein the electronic organ is energized and no key switch is closed, no voltage is applied from the power source 1 to any of the AND gates 201 to 216 and the output from of the AND gates 201 to 216 is accordingly in a low level state. Consequently, no AND gate 401 to 416 is triggered on and no tone signal from any of the tone sources 301 to 316 is allowed to pass therethrough.

On the other hand, the NOR gate 2 generates a high level output signal which triggers the AND gate 8 on to pass therethrough a train of high frequency pulses generated from the pulse generator 7 having a waveform as shown by in FIG. 3(*as*). The pulse train emerging from the AND gate 8 is fed through the OR gate 9 to the count terminal of the counter 10 so that the number of the high frequency pulses is counted thereby. The binary-coded pulses emerging from the counter 10 are then applied to the decoder 6 and converted into trains of hexadecimal-coded pulses which successively appear on the output lines 501 to 516, said trains of hexadecimal-coded pulses having waveforms as respectively shown by FIGS. 3(*b*), (*c*), (*d*), (*e*) . . . (*f*), (*g*) . . . (*h*) and (*i*).

In other words, each of the output lines 501 to 516 of the decoder 6 is always in the high level state and this high level state is shifted to the next succeeding output line each time one high frequency pulse is applied to the counter 10. By way of example, assuming that the output line 501 is in the high level state, the other output lines 502 to 516 successively are placed in a high level state in a sequential manner each time one high frequency pulse is applied from the high frequency pulse generator 7 to the counter 10. After the output line 516 has completed being in the high level state and when a high frequency pulse of the next succeeding cycle is subsequently applied to the counter 10 from the pulse generator 7, the high level state is shifted back to the output line 501 and, in such a manner, the decoder 6 cylically generates output pulses through the output lines 501 to 516.

The speed of shift of the high level state from one output line to the next succeeding output line depends upon the frequency of the pulses generated by the pulse generator 7. By way of example, if the frequency of pulses generated by the pulse generator 7 is 100 KHz, high frequency pulses from the pulse generator 7 are successively applied to the count terminal of the counter 10 at intervals of 10$\mu$ sec. and, therefore, the shift of the high level state from one output line to the next output line of the decoder 6 is completed in 10$\mu$ sec. Consequently, each cycle of the shift, if the number of the output lines of the decoder 6 is 16 as is the case of the illustrated embodiment, is completed in 0.16 millisecond.

When the key switch 103 is closed and if the output line 501 is in a high level state, the output of the AND gate 201 is in a low level state since the key switch 101 is opened, and the output of the AND gate 203 is also in a low level state since the output line 503 is in a low level state even during closure of the key switch 103. The remaining ones of the AND gates 201 to 216 are in a low level state since the corresponding key switches are opened and the corresponding output lines of the decoder 6 are also in a low level state. Consequently, no AND gate 201 to 216 is triggered on while the NOR gate 2 generates a high level output which triggers the AND gate 8 on to pass a train of high frequency pulses therethrough to the count terminal of the counter 10 by means of the OR gate 9 whereby the output line 502 of the decoder 6 changes to a high level while the output line 501 that has been in the high level state changes to a low level state.

When the output line 502 of the decoder 6 is thus in the high level state, the output of the AND gate 202 is in a low level state since the key switch 102 is opened, and the output of all of the other ones of the AND gates 201 to 216 is in a low level state in a similar manner as hereinbefore described, while the NOR gate 2 generates a high level output which triggers the AND gate 8 on to pass a train of high frequency pulses therethrough to the count terminal of the counter 10 by means of the OR gate 9 whereby the output line 503 of the decoder 6 changes to a high level while the output line 502 that has been in the high level state changes to in a low level state.

When the output line 503 of the decoder 6 is thus in the high level state, both input terminals of the AND gate 203 receive high level signals since the key switch 103 is closed. As a result, the AND gate 203 is triggered on to generate a high level signal therethrough to the AND gate 403 even though the remaining ones of the AND gates 201 to 216 are in a low level state and, on the other hand, the output of the NOR gate 2 changes to a low level state and the output of the AND gate 8 is accordingly in a low level state. Consequently, no pulse from the high frequency pulse generator 7 is permitted to pass through the OR gate 9 and, therefore, the counter 10 ceases its counting operation so that the output line 503 of the decoder 6 can be held in the high level state. Accordingly, the AND gate 203 continues to generate the high level signal so long as the key switch 103 is closed, which high level signal from the AND gate 203 is fed to the AND gate 403 to trigger the latter on to pass therethrough the tone signal from the tone signal source 303 to the divider 15 by means of the OR gate 3. The divider 15 upon receipt of the tone signal generates to the keying circuit 4 a signal indicative of a bass formed by the tone which is associated with the depressed key in turn associated with the key switch 103.

When the key switch 103 is opened during a period in which the output line 503 is in the high level state, the output of the AND gate 203 changes to a low level state while the output of the NOR gate 2 changes to a high level state and, accordingly, high frequency pulses from the pulse generator 7 are permitted to pass through the OR gate 9 and are then applied to the count terminal of the counter 10. Consequently, the output line 503 changes to a low level state while the next succeeding output line 504 changes to a high level state.

In summary, so long as no key switch 101 to 116 is closed, the output lines 501 to 516 of the decoder 6 are successively brought into a high level state in a cyclic manner and no tone signal from any of the tone signal sources 301 to 316 is permitted to pass through the corresponding AND gate 401 to 416 to the OR gate 3. However, when any one of the key switches, for example, the key switch 103 is closed, the successive shift of the high level state on the output lines 501 to 516 ceases when the output line 503 is brought into the high level state and, therefore, a tone signal from one of the tone signal sources 301 to 316 which is associated with the depressed key is available from the OR gate 3 so long as the output line 503 is held in the high level state, that is, the key switch 103 is closed.

Although in the foregoing description the counter 10 has been described as performing an up-count operation, a down-count operation of the counter 10 can be performed in a similar manner as the up-count operation. In other words, during the down-count operation of the counter 10, the output lines of the decoder 6 are successively brought into a high level state in a substantially reverse manner as during the up-count operation.

Referring still to FIG. 2, the rhythm pulse generator 11 generates through the output line 12 rhythm pulses in accordance with the rhythm of a selected musical composition such as swing or a waltz and through the output line 13 pulses each indicative of the first beat present in the individual measures. The rhythm pulse generated by the generator 11 through the output line 12 is applied in part to the count terminal of the counter 10 through the AND gate 9 so that the counting state of the counter 10 can be advanced by one increment and in part to the envelope circuit 5. The pulse indicative of the first beat present in a measure of the rhythm being performed which is generated by the generator 11 through the output line 13 is applied in part to the reset terminal of the counter 10 so that only the output line 501 of the decoder 6 will be held in the high level state and in part to the flip-flop circuit 16 so that the counting state of the counter 10 can be reversed each time the pulse is applied thereto.

It is assumed that the rhythm pulse generator 11 generates pulses as shown in FIGS. 4(*a*) and (*b*), respectively, through the output lines 12 and 13, that the key switches 102, 106, 109, 112 and 114 are all simultaneously closed, that the flip-flop circuit 16 has been reset simultaneously with closure of these key switches, and that the counter 10 therefore commences an up-counting operation. If a pulse 121 and shown in FIG. 4(*a*) is generated by the generator 11 through the output line 12, this pulse 121 is in turn applied to the counter 10 through the OR gate 9. However, since a pulse 131 as shown in FIG. 4(*b*) is also generated by the generator 11 through the output line 13, this pulse 131 is in turn applied to the counter 10 to reset the latter. Therefore, the output line 501 of the decoder 6 is brought into the high level state.

However, since the key switch 101 is not closed, the decoder 6 is conditioned by the high frequency pulses from the high frequency pulse generator 7 such that the high level state is shifted from the output line 501 to the next succeeding output line 502 and no further shift takes place since the key switch 102 is closed. In view of the fact that the output line 502 is held in the high level state, the tone signal from the tone signal source 302 is permitted to pass through the AND gate 402 and is thus fed through the OR gate 3 to the divider 15 from which an electric signal indicative of the sound of a depressed lower manual key is generated and supplied to the keying circuit 4.

On the other hand, the pulse 121 on the output line 12 of the generator 11 is also applied to the envelope circuit 5 to cause the latter to generate a drive signal of a required voltage, which drive signal is then applied to the keying circuit 4 to trigger the keying circuit 4 on to pass the electric signal indicative of the sound of the depressed lower manual key therethrough to the output terminal 14.

The signal thus obtained at the output terminal 14 is suitably processed, for example, amplified by an amplifier, and then reproduced through a sound reproducing system.

It is to be noted that the pulses 121 and 131 separately generated by the generator 11 through the output lines 12 and 13 are synchronized with each other and, therefore, at the same time as the envelope circuit 5 is brought into operation by the pulse 121, the counter 10 is reset so that the high level signal emerges from the decoder 6 through the output line 501. However, in this instance, no tone signal from any of the tone signal sources 301 to 316 can pass through the OR gate 3. Only when the output line 502 of the encoder 6 is brought into the high level state, can the tone signal from the tone signal source 302 be fed through the OR gate 3 to the divider 15, the output of which divider 15 is then fed to the keying circuit 4.

In other words, there is a time lag between the time at which the envelope circuit 5 is operated and the time at which the output of the divider 15 is fed to the keying circuit 4. This time lag is in practice very small and, for example, if the frequency of the high frequency pulse generated by the generator 7 is 100 KHz, the time lag in question would be $20/\mu$ sec. which is negligible in view of the fact that the rise time of the envelope voltage of the envelope circuit 5 is approximately 10 milliseconds.

When a pulse 122 shown in FIG. 4(*a*) is generated by the pulse generator 11 through the output line 12 (at this time, as can be seen from FIG. 4, no pulse is generated by the pulse generator 11 through the output line 13 and, therefore, the counter 10 is not reset and the flip-flop circuit 16 is not reversed), the pulse 122 is applied through the OR gate 9 to the counter 10 to cause the latter to be advanced by one increment so that the high level state of the decoder 502 is shifted from the output line 502 to the next succeeding output line 503. The high level state of the output line 503 is immediately shifted to the output line 504 and then to the output line 505 due to the fact that each of the key switches 103 to 105 is not closed. The high level state is held when it is shifted to the output line 506 because of closure of the corresponding key switch 106 and, consequently, the tone signal from the tone signal source 306 corresponding to the closed key switch 106 is permitted to pass through the OR gate 3 to the divider 15, the output of which divider 15 is then applied to the keying circuit 4. On the other hand, the pulse 122 on the output line 12 operates the envelope circuit 5 to cause the latter to generate the drive signal used to open the keying circuit 4 to permit the latter to pass therethrough the output signal from the divider 15 to the output terminal 14, which output signal is indicative of the sound of the depressed key.

Similarly, when each of pulses 123 and 124 appears on the output line 12 of the generator 11, a similar operation takes place as hereinbefore described and the tone signals from the tone signal sources 309 and 312 corresponding to the key switches 109 and 112 are individually applied to the divider 15 through the OR gate 3, outputs from which divider 15 are then applied to the keying circuit 4.

Upon generation of a pulse 125 from the pulse generator 11 through the output line 12, this pulse 125 is applied to the counter 10 through the OR gate 9. On the other hand, since a pulse 132 also appears on the output line 13 at this time, this pulse 132 is applied in part to the counter 10 to reset the latter so that the output line 501 of the decoder 6 is brought into the high level state and in part to the flip-flop circuit 16 to reverse the state thereof so that the counter 10 is brought into condition to perform the down-counting operation. At this time, since the key switch 101 is not closed, the high level state on the output line 501 is shifted to the output line 516, then to the output line 515 and finally to the output line 514 by the high frequency pulses from the pulse generator 7 and the output line 514 is held in the high level state since the key switch 114 is closed.

During the time when the output line 514 is held in the high level state, the tone signal from the tone signal source 314 is permitted to pass through the OR gate 3 to the divider 15 from which an output signal indicative of the sound of the depressed key is generated to the keying circuit 4. On the other hand, the pulse 125 on the output line 12 of the generator 11 is fed to the envelope circuit 5 from which a drive signal having the required envelop voltage is generated and supplied to the keying circuit 4 to open the latter to permit the output signal from said divider 15 to be fed to the output terminal 14.

Similarly, when each of pulses 126, 127 and 128 appears on the output line 12 of the pulse generator 11, a similar operation takes place as hereinbefore described and the tone signals from the signal sources 312, 309, and 306 are individually applied to the divider 15 through the OR gate 3, output signals from which divider 15 are then successively applied to the keying circuit 4.

When a pulse 133 shown in FIG. 4(*b*) is subsequently generated by the generator 11 through the output line 13, this pulse 133 is applied to the counter 10 to reset the latter and to the flip-flop circuit 16 to reverse the state thereof so that the counter 10 performs the up-counting operation.

In a similar way, the rhythm pulses and the reset pulses are repeatedly generated on the output lines 12 and 13, respectively. Accordingly, if the key switches 102, 106, 109, 112 and 114 are closed in response to depression of the corresponding number of keys which, for example, correspond respectively to tones of $C_2$, $E_2$, $G_2$, $B_2^b$ and $C_3$ as shown in FIG. 4(*c*), basses of $C_1$, $E_1$, $G_1$, $b_1^b$ and $C_2$ can be formed in accordance with chords produced by the depression of these keys, which basses are broken in each measure as shown in FIG. 4(*d*).

It should be noted that the manner in which the chords can be formed is not herein described for the sake of brevity because it may be any known method.

As hereinbefore described, if a plurality of arbitrarily chosen keys are simultaneously depressed, the counter 10 can be reset and performs the counting operation at a rapid pace until one of the output lines of the decoder 6, which corresponds to one of the depressed keys which produces the lowest tone, is brought into the high level state. The counting operation of the counter 10 ceases at the time the output line of the decoder 6 which corresponds to the depressed key which produces the lowest tone is held in the high level state. By advancing the counting state of the counter 10 by one increment in response to one rhythm pulse after the lapse of a predetermined time, the counter 10 again performs at a rapid pace the counting operation until the next succeeding output line of the decoder 6, which corresponds to the second one of the depressed keys, is brought into the high level state, the counting operation of said counter 10 ceasing at the time said output line of said decoder 6 is brought into the high level state. In a similar manner, the counter 10 performs the counting operation at a rapid pace each time one rhythm pulse is applied, to successively detct the third and fourth depressed keys.

Upon subsequent generation of the reset pulse the counter 10 is reset and, at the same time, the flip-flop circuit 16 is inverted so that the counter 10 performs the down-counting operation at a rapid pace until the output line of the decoder 6, which corresponds to the depressed key which produces the highest tone, is brought into the high level state, said down-counting operation of the counter 10 ceasing at the time said output line is actually held in the high level state. By advancing the counting state of the counter 10 by one increment in response to one rhythm pulse after the lapse of a predetermined time, the counter 10 again performs at a rapid pace the down-counting operation until the next succeeding output line of the decoder 6, which corresponds to the depressed key which produces the tone next lower than the highest tone, is brought into the high level state and ceases its operation at the time said output line is actually held in the high level state. In a similar manner, the counter 10 performs the down-counting operation at a rapid pace each time one rhythm pulse is applied, to successively detect the depressed keys which produce respective tones which are the third and fourth ones lower than the highest tone.

In this way, each time the reset pulse corresponding to the first beat in the individual measures as shown in FIG. 4(*b*) is generated, the counter 10 is reset and the up and down counting operations thereof are alternatively reversed.

Accordingly, the high frequency pulses from the high frequency pulse generator 7 are rapidly sequenced pulses while the rhythm pulses from the rhythm pulse generator 11 which appear on the output line 12 are slowly sequenced pulses.

The rapidly sequenced pulses have a cycle of approximately $10\mu$ sec. while the slowly sequenced pulses have a cycle of approximately 100 milliseconds though they may vary depending upon the type of rhythm selected.

According to the foregoing embodiment of the present invention which has been fully described, the system is designed such that merely by depressing a plurality of arbitrarily chosen keys in the keyboard arrangement, the basses formed by the tones of the depressed keys can be sequentially played from the lowest component to the highest component or from the highest component to the lowest component, within the lowest register and, therefore, the walking bass can be performed in accordance with the selected rhythm.

As compared with the prior art system of a similar kind wherein the basses are formed by the highest or lowest tone of one of the depressed keys, the system according to the foregoing embodiment of the present invention provides a superior accompaniment. Moreover, since no AND gates are employed to detect the chords formed by the depression of the keys, the system according to the foregoing embodiment is not affected by the type of chord and its inversions and requires substantially no more AND gates than herein disclosed.

Furthermore, according to the foregoing embodiment of the present invention, even if a certain key is erroneously depressed, only the bass is formed by the resultant tone of the erroneously depressed key in contrast to the prior art system wherein no bass is formed when a key is erroneously depressed. In addition, even if the number of keys that have been depressed is one or more, the bass formed by the depression of the depressed key or keys can be reproduced with no fault. On the contrary thereto, according to the prior art system, the number of keys that have been depressed is required to be three or more or otherwise no bass is reproduced. Instead of the counter 10 and decoder 6, a ring counter 17, as shown in FIG. 11, or a shift register may be employed.

It should be noted that the details of the divider 15 are not part of the subject matter of the present invention and, however, depending upon the pitch of the tones produced by the tone signal sources 301 to 316, the divider 15 may be omitted or may require a plurality of states, for example, two or three stages.

In addition, switching of the up-counting and down-counting operations of the counter 10 may not always be carried out in response to the first beat in each measure, but may be carried out every two measures, and the alternating bass of the highest and lowest tones can be formed if this switching is effected in response to the rhythm pulse appearing on the output line 12 of the rhythm pulse generator 11.

Referring now to FIG. 5 in which a second preferred embodiment of the present invention is shown, a source of electrical power 1 is, for the sake of brevity, shown in the form of a DC battery source having a negative terminal grounded and a positive terminal connected to one input terminal of each of AND gates 201, 202, 203, 204 . . . 215 and 216 through a corresponding one of key switches 101, 102, 103, 104 . . . 115 and 116. The key switches 101 to 116 are to be understood as operatively associated with respective keys, for example, lower manual keys (not shown), in such a way that only when any of the keys on the keyboard arrangement are depressed, corresponding key switches which are associated with the depressed keys are closed to complete an electrical circuit between the power source 1 and the related AND gate.

Output terminals of the AND gates 201 to 216 are all connected in shunt to respective input terminals of an OR gate 2 and to one input terminal of respective AND gates 401, 402, 403, 404 . . . 415 and 416, the other input terminals of these AND gates 401 to 416 being connected with respective sources of musical tones 301, 302, 303, 304 . . . 315 and 316.

Output terminals of the AND gates 401 to 416 are all connected to respective input terminals of an OR gate 3, the output terminal of which OR gate 3 is connected to an output terminal 14 through a keying circuit 4.

Reference numeral 8 indicates a 5-bit ring counter adapted to count the number of pulses fed from the OR gate 2 and having output lines 600, 601, 602, 603 and 604. The output lines 601, 602, 603 and 604 are connected respectively to the one input terminals of respective AND gates 701, 702, 703 and 704 the, output terminals of which AND gates 701, 702, 703 and 704 are all connected to respective input terminals of a NOR gate 12.

A high frequency pulse generator 7 and an output terminal of the NOR gate 12 are connected to respective input terminals of an AND gate 13 which is in turn connected to a count terminal of a 4-bit, binary counter 10.

The counter 10 is connected to a decoder 6 which acts to decode or convert binary-coded, 4-bit pulses that have been fed thereto from the counter 10 into hexadecimal-coded pulses, and has output lines 501, 502, 503, 504 . . . 515 and 516 which are respectively connected to the individual other terminals of the AND gates 201 to 216.

Reference numeral 9 designates a rhythem pulse generator having output lines 801, 802, 803 and 804 all connected to respective other input terminals of the AND gates 701 to 704 and also having an output line 11 connected in shunt to reset terminals of respective counters 8 and 10 and also to an envelope circuit 5 which drives the keying circuit 4.

In describing the operation of the system of the above described arrangement, it is assumed that the rhythm pulse generator 9 generates pulses as shown by FIGS. 7(*a*), (*b*), (*c*), (*d*), and (*e*) in FIG. 8 through the output lines 11, 801, 802, 803 and 804, respectively. When the pulse shown by FIG. 7(*a*) is applied to the reset terminal of the ring counter 8 at a time $t_1$, the output line 600 of the ring counter 8 is brought into a high level state while the other output lines 601 to 604 remain in a low level state. Accordingly, the AND gates 701 to 704 generate a low level signal irrespective of the state of each of the output lines 801 to 804 of the pulse generator 9 and, during this condition, the NOR gate 12 generates a high level signal to the AND gate 13. On the other hand, a train of high frequency pulses shown in FIG. 3(*a*) is continuously generated from the pulse generator 7 during energization of the electronic organ and, therefore, when the high level pulse is applied to the gate 13 from the NOR gate 12, the gate 13 is triggered on to pass the high frequency pulse train therethrough to the count terminal of the counter 10 so that the number of the high frequency pulses can be counted thereby. The binary-coded pulses emerging from the counter 10 are then applied to the decoder 6 and converted into trains of hexadecimal-coded pulses which successively appear on the output lines 501 to 516, said trains of hexadecimal-coded pulses having waveforms as respectively shown in FIGS. 3(*b*), (*c*), (*d*), (*e*) . . . (*f*), (*g*) . . . (*h*) and (*i*).

In other words, one of the output lines 501 to 516 of the decoder 6 is always in the high level state and this high level state is shifted to the next succeeding output line each time one high frequency pulse is applied to the counter 10. By way of example, assuming that the output line 501 is in the high level state, the other output lines 502 to 516 are successively change to the high level state in a sequential manner each time one high frequency pulse is applied from the high frequency pulse generator 7 to the counter 10. After the output line 516 has been placed in the high level state and when a high frequency pulse of the next succeeding cycle is subsequently applied to the counter 10 from the pulse generator 7, the high level state is shifted back to the output line 501 and, in such a manner, the decoder 6 cyclically generates an output pulse through the output lines 501 to 516.

The speed of shift of the high level state from one output line to the next succeeding output line depends upon the frequency of pulses generated by the pulse generator 7. By way of example, if the frequency of pulses generated by the pulse generator 7 is 10 KHz, high frequency pulses from the pulse generator 7 are successively applied to the count terminal of the counter 10 at intervals of 10 $\mu$ sec. and, therefore, the shift of the high level state from one output line to the next output line of the decoder 6 is completed in 10 $\mu$ sec. Consequently, each cycle of the shift, if the number of the output lines of the decoder 6 is 16 as is the case of the illustrated embodiment, is completed in 0.16 millisecond.

When the key switches 101, 103 and 105 are, for example, closed and if the output line 501 is brought into the high level state at this time, the AND gate 201 generates a high level signal in response to closure of the key switch 101, which high level signal is in turn applied to the ring counter 8 through the OR gate 2. This high level signal applied to the ring counter 8 enters the count terminal of the ring counter 8 whereby the condition wherein the output line (600) of the ring counter 8 has been in the high level state while the other output lines 601 to 604 have been in the low level state changes to a condition wherein the output line 601 is brought into a high level state while the other output lines 600, 602, 603 and 604 are in the low level state.

On the other hand, since the output line 801 of the rhythm pulse generator 9 is in the high level state as shown by FIG. 7(*b*), output from the AND gate 701 becomes a high level state and the NOR gate 12 accordingly generates a low level signal. Therefore, no high frequency pulse from the generator 7 is supplied to the counter 10 and, as a result, the counter 10 ceases to count and the output line 501 of the decoder 6 is held in the high level state. So long as the key switch 101 is closed, the output of the AND gate 211 is in the high level state until the pulse shown in FIG. 7(*a*) is, at the time of $t_2$, generated by the rhythm pulse generator 9 through the output line 11 and then applied to the counter 10 to reset the latter. Therefore, a tone signal from the tone signal source 301 corresponding to the closed key switch 101 is fed to the keying circuit 4 through the AND gate 401 by means of the OR gate 3.

During the time $t_2$ shown in FIG. 7, the ring counter 8 and the counter 10 are respectively reset by the pulse shown in FIG. 8(*a*) which is generated from the rhythm pulse generator 9. Accordingly, the output line 600 of the ring counter 8 is held in the high level state while the other output lines 601 to 604 are in the low level state and, accordingly the output from the NOR gate 2 is in the high level state so that the high frequency pulse from the pulse generator 7 is supplied to the counter 10 through the AND gate 13. By this pulse, the output line 501 of the decoder 6 is brought into the high level state and the output from the AND gate 201 is correspondingly brought into the high level state since the key switch 101 is closed. Therefore, the output line 601 of the ring counter 8 is brought into the high level state. However, since the output line 803 of the pulse generator 9 is in the high level state while the other output lines of the same are in the low level state, the AND gates 701 to 704 generate low level signals and the NOR gate 12 accordingly generates the high level signal. Therefore, the high frequency pulses from the pulse generator 7 are permitted to pass through the AND gate 13 to the counter 10 and the output line 502 of the decoder 6 is brought into the high level state. Even though the output line 502 is thus brought into the high level state, since the key switch 102 is open, the AND gate 202 generates a low level signal, therefore, the state of the ring counter 8 does not vary. When the output line 503 is subsequently brought into the high level state, since the key switch 103 is closed, the AND gate 203 is brought into condition to permit passage of pulses and the ring counter 8 is conditioned such that the output line 602 is brought into the high level state while the output lines 601, 603 and 604 are in the low level state. As regards the output lines of the rhythm pulse generator 9, only the output line 803 is brought into the high level state while the other output lines 801, 802 and 804 are in the low level state and, accordingly, the NOR gate 12 generates the high level signal. The high level signal from the NOR gate 12 is applied to the AND gate 13 to trigger the latter on to pass the high frequency pulses from the pulse generator 7 to the counter 10. Accordingly, the output line 504 of the decoder 6 is brought into the high level state, but since the key switch 104 is open, the state of the ring counter 8 does not vary.

When the output line 505 of the decoder 6 is subsequently brought into the high level state, since the key switch 105 is closed, the AND gate 205 generates a high level signal and, accordingly, the output line 603 of the ring counter 8 is brought into the high level state while the other output lines of the same are in the low level state. Since the output line 803 of the pulse generator 9 is at this time in the high level state, the AND gate 703 generates the high level signal and the NOR gate 12 therefore generates the low level signal. Consequently, no high frequency pulse from the pulse generator 7 is applied to the counter 10 and the counter 10 therefore ceases its counting operation so that the output line 505 of the decoder 6 can be held in the high level state. The output of the AND gate 205 is therefore maintained in the high level state until the pulse shown in FIG. 7(*a*) is, at the time of $t_3$, generated by the pulse generator 9 through the output line 11 and then applied to the counter 10 to reset the latter. Therefore, a tone signal from the tone signal source 305 corresponding to the closed key switch 105 is fed to the keying circuit 4 through the AND gate 405 by means of the OR gate 3.

Similarly, during the time $t_3$ shown in FIG. 7, since the output line 802 of the pulse generator 9 is in the high level state, when the count terminal of the ring counter 8 receives three pulses, that is, when the output line 503 of the decoder 6 is brought into the high level state, no pulse from the high frequency pulse generator 7 is applied to the counter 10 and the output of the AND gate 203 is held in the high level state and, consequently, the tone signal from the tone signal source 203 correspond-into to the key switch 103 is applied to the keying circuit 4 through the AND gate 403 and then the OR gate 3. On the other hand, a pulse shown in FIG. 7(*a*) which appears on the output line 11 of the pulse generator 9 is applied to the envelope circuit 5 whereby an envelope voltage is generated and supplied to the keying circuit 4 to open the latter to permit the passage of the tone signal fed thereto through the OR gate 3 to the output terminal 14. In this case, at the same time the envelope circuit 5 is operated, the ring counter 8 and the binary counter 10 are simultaneously reset by the pulse shown in FIG. 7(*a*) which has appeared on the output line 11 and, until the output of the NOR gate 12 is brought into the high level state, high frequency pulses from the pulse generator 7 are applied to the counter 10 so that the output lines of the decoder 6 can be successively brought into the high level state. Therefore, there is a time lag between the time at which the envelope circuit 5 is operated and the time at which the tone signal is supplied to the keying circuit 4 through the OR gate 3. This time lag is in practice very small and, for example, if the frequency of the high frequency pulse generated by the generator 7 is 100 KHz, the time lag in question would be 160 $\mu$ sec. even in the case where the tone signal from the tone signal source 316 corresponding to the key switch 116 is supplied to the keying circuit 4, which lag is negligible in view of the fact that the rise time of the envelope voltage of the envelope circuit 5 is approximately 10 milliseconds.

In a similar manner as hereinbefore described, rhythm pulses successively appear on the output lines 11, 801, 802, 803 and 804 of the pulse generator 9. Accordingly, if the key switches 101, 103 and 105 are closed in response to depression of the corresponding number of keys which, for example, correspond respectively to tones of $C_2$, $E_2$ and $G_2$ as shown in FIG. 7(*f*), chords formed by the tones of the depressed keys can be formed in the form of broken chords, as shown in FIG. 7(*g*), merely by depressing such keys.

As hereinbefore described, if a plurality of arbitrarily chosen keys are simultaneously depressed, the counter 10 undergoes the counting operation at a rapid pace until the output line of the decoder 6, which corresponds to the first one of the depressed keys if the output line 801 of the pulse generator 9 is in the high level state at the time the ring counter 8 and the binary counter 10 are both reset, or to the second one of the depressed key if the output line 802 of the pulse generator 9 is in the high level state at the time the ring counter 8 and the binary counter 10 are both reset, or to the third one of the depressed keys if the output line 803 of the pulse generator 9 is in the high level state at the time the ring counter 8 and the binary counter 10 are both reset, or to the fourth one of the depressed key if the output line 804 of the pulse generator 9 is in the high level state at the time the ring counter 8 and the binary counter 10 are both reset, is brought into the high level state, said counting operation of said binary counter 10 ceasing at the time the output line of the decoder 6 is thus brought into the high level state. In other words, each time a pulse shown in FIG. 7(*a*) is applied, in accordance with the state of the output lines of the ring counter 8, the first to fourth keys are successively selected. In view of this, the high frequency pulses from the high frequency pulse generator 7 are rapidly sequenced pulses while the rhythm pulses from the rhythm pulse generator 9 which appear on the output line 11 are slowly sequenced pulses. The pulses generated by the rhythm pulse generator 9 through the output lines 801 to 804 are the ones which are used to determine which key is depressed among the depressed keys.

The rapidly sequenced pulses have a cycle of approximately 10 $\mu$ sec. while the slowly sequenced pulses have a cycle of approximately 100 milliseconds though they may vary depending upon the type of tempo selected. It is to be noted that if signals appearing on the count input line of counter 8 and the output lines 801, 802, 803 and 804 of the pulse generator 8 are respective trains of cycle pulses shown in FIGS. 8(*a*), (*b*), (*c*), (*d*) and (*e*) and FIGS. 9(*a*), (*b*), (*c*), (*d*) and (*e*) in FIG. 10, mere depression of keys corresponding to the tones of $C_2$, $E_2$ and $G_2$ or $C_2$, $E_2$, $F_2$ and $G_2$ would result in automatic reproduction of broken chords such as shown in FIG. 8(*f*) or FIG. 9(*f*), respectively.

According to the second preferred embodiment of the present invention which has been fully described, the system is designed such that merely by depressing a plurality of arbitrarily chosen keys on the keyboard arrangement, the tones represented by these depressed keys can be successively sounded thereby providing an accompaniment in the form of broken chords. Therefore, a beginner on an electronic organ can perform accompaniment of broken chords with his left hand which has heretofore been considered difficult.

Although the foregoing, second preferred embodiment of the present invention has been described in connection with the accompaniment of broken chords to be performed by the left hand of the player, it should be noted that if a divider circuit is provided between the output terminal of the OR gate 3 and the input terminal of the keying circuit 4, the walking bass can be automatically reproduced such as shown in FIG. 6(*b*) merely by depressing some of the keys on the keyboard arrangement which correspond to chords shown in FIG. 6(*c*). It is to be noted that although an automatic accompaniment of the chords shown in FIG. 6(*a*) is not herein described, it may be achieved by any known method.

From the foregoing full description of the present invention, it has now become clear that, since the essential portion of the automatic accompaniment system of the present invention is composed of a digital circuit in which there are only two states, i.e., a high level and a low level, the operation thereof is reliable and various components of the system can be placed in an integrated circuit so that the overall system can be manufactured in a very compact size.

Furthermore, in the foregoing description in connection with each of the preferred embodiments of the present invention, the keyboard arrangement has been described as composed of 16 keys and the counter 10 has been described as having 4 bits. However, if the counter 10 has 5 bits or 6 bits, the system of the present invention can be applied to a keyboard arrangement composed of 32 keys or 64 keys, respectively.

Moreover, though the ring counter 8 has been described as capable of a counting operating under the pentanary system, the employment of a ring counter capable of counting operation under the arithmetic system of $(n+l)$ radix will result in broken chords being formed by tones corresponding to $n$ keys of the arbitrarily depressed keys.

Furthermore, instead of the employment of the binary counter 10 and the decoder 6, a ring counter 10, as shown in FIG. 10, or an up-down counter 18 as shown in FIG. 11 or and a shift register may be used. In addition, instead of the ring counter 8, a combination of a binary counter and a decoder can be used and, instead of the AND gates and the OR gates, a NOR gate or a NAND gate may be employed, and vice versa. Moreover, any other logic circuits may be employed if they operate in a similar manner as hereinbefore described to achieve the intended objects.

Although the present invention has been described in conjunction with the preferred embodiments thereof, it should be noted that various changes and modifications are apparent to those skilled in the art. Such changes and modifications are, unless otherwise they depart from the true scope of the present invention, to be understood as included therein.

What is claimed is:

1. An automatic accompaniment system for use with an electronic musical instrument having a plurality of keys, which comprises:

a plurality of key switches corresponding in number to the number of said keys and respectively operatively associated with said keys, each of said key switches being closed when a corresponding one of said keys is depressed, a plurality of tone sources corresponding in number to the number of said keys for generating individual signals indicative of tones of different pitches which correspond to respective pitches of tones which it is desired to provide by depression of said keys, means for generating rhythm pulses in accordance with a predetermined rhythm of a selected music, means for generating high frequency pulses of a predetermined high frequency, a binary counter having n-bits and adapted to count the number of high frequency pulses applied thereto from said high frequency pulse generating means, decoding means for converting binary-coded pulses, that have been fed thereto from said binary counter, into $2^n$-radix coded pulses, said decoding means having a plurality of output lines, means for detecting depression of one or more of said keys, said detecting means including a plurality of logical gating elements corresponding to the number of keys and each having a pair of input terminals respectively connected to a corresponding one of said output lines of decoding means and a corresponding one of said key switches, means for causing said binary counter to cease its counting operation by providing a barrier to passage of said high frequency pulses from said high freqeuency pulse generating means therethrough when said detecting means detects that one or more of the keys that have been depressed and the pulse applied to output terminals of said decoding means which are associated with the depressed key or keys coincide with each other, a plurality of separate switching means corresponding to the number of said tone sources, each switching means being coupled to a corresponding tone generator and a corresponding detecting means operable to permit passage of a tone signal therethrough from the associated tone source when the corresponding key is depressed and a pulse is received from said decoding means, means coupled between said rhythm pulse generating means and said binary counter for resetting the latter to cause said binary counter to perform its counting operation until one of depressed keys which is responsible for the lowest pitch and a pulse on one of the output lines of said decoding means coincide with each other, and means for generating a bass to be sounded and coupled to said switching means, said bass being sounded on the basis of the tone signals received from said tone sources.

2. An automatic accompaniment system as claimed in claim 1, wherein said binary counter is a counter which ceases its counting operation when said said one of depressed keys which is responsible for the lowest pitch and the pulse on said one of the output lines of said decoding means coincide with each other.

3. An automatic accompaniment system as claimed in claim 1, wherein said binary counter is a binary counter in which the state of said binary counter during an inoperative condition is advanced by one increment each time the rhythm pulse is applied thereto from said rhythm pulse generating means, so that the counting operation of said binary counter is re-initiated until another one of depressed keys which is responsible for a pitch next to the lowest pitch and the pulse on an output line of said decoding means coincide with each other.

4. An automatic accompaniment system is claimed in claim 1, wherein said binary counter and said decoding means together constitute a ring counter.

5. An automatic accompaniment system for use with an electronic musical instrument having a plurality of keys, which comprises:

a plurality of key switches corresponding in number to the number of said keys and respectively operatively associated with said keys, each of said key switches being closed when a corresponding one of said keys is depressed, a plurality of tone sources corresponding in number to the number of said keys for generating individual signals indicative of tones of different pitches which correspond to respective pitches of tones which it is desired to produce by depression of said keys, means for generating rhythm pulses in accordance with a predetermined rhythm of a selected music, means for generating high frequency pulses of a predetermined high frequency, an up-down binary counter having n-bits and adapted to count the number of high frequency pulses applied thereto from said high frequency pulse generating means, up-down control pulse generating means operable in response to one of the rhythm pulses for generating an up-down control pulse in a timed relation to said one of said rhythm pulses, said up-down control pulse being used to determine whether said binary counter is performing an up-counting operation or whether said binary counter is performing a down-counting operation, decoding means for converting binary-coded pulses, that have been fed thereto from said binary counter, into $2^n$-radix coded pulses, means for detecting depression of one or more of said keys, said detecting means including a plurality of logical gating elements corresponding in number to the number of said keys and each having a pair of input terminals respectively connected to a corresponding one of said output lines of said decoding means and a corresponding one of said key switches, means for causing said binary counter to cease its counting operation by providing a barrier to passage of said high frequency pulses from said high frequency pulse generating means therethrough when said detecting means detects that one or more of the keys that have been depressed and the pulse applied to output terminals of said decoding means which are associated with the depressed key or keys coincide with each other, a plurality of separate switching means corresponding in number to the number of said tone sources, each switching means being coupled to corresponding tone generator and a corresponding key depression detecting means and operable to permit passage of a tone signal therethrough from the associated tone source when the corresponding key is depressed and a pulse is received from said decoding means, means coupled between said rhythm pulse generating means and said binary counter for resetting the latter to cause said binary counter to perform its counting operation until one of depressed keys which is responsible for the lowest pitch in the case where the binary counter performs the up-counting operation energized by said control signal or one of depressed keys which is responsible for the highest pitch in the case where the biinary counter performs the down-counting operation and a pulse on one of the output lines of said decoding means coincide with each other, and means for generating a bass to be sounded and coupled to said switching means, said bass being sounded on the basis of the tone signals received from said tone sources.

6. An automatic accompaniment system as claimed in claim 5, wherein the binary counter is a binary counter in which the state of said binary counter during an inoperative condition is advanced by one increment each time the rhythm pulse is applied thereto from said rhythm pulse generating means, so that the counting operation of said binary counter is re-initiated until another one of depressed keys which is resonible for a pitch next to the lowest or highest pitch and the pulse on an output line of said decoding means coincide to each other.

7. An automatic accompaniment system as claimed in claim 6, wherein said binary counter and said decoding means are constituted by an up-down ring counter.

8. An automatic accompaniment system for use with an electronic musical instrument having a plurality of keys, which comprises:

a plurality of key switches corresponding in number to the number of said keys and respectively operatively associated with said keys, each of said key switches being closed when a corresponding one of said keys is depressed, a plurality of tone sources corresponding in number to the number of said keys for generating individual signals indicative of tones of different pitches which correspond to respective pitches of tones which it is desired to produce by depression of said keys, means for generating rhythm pulses in accordance with a predetermined rhythm of a selected music, means for generating a selection signal for selecting one of some of the keys which are depressed, means for generating high frequency pulses of a predetermined high frequency, a first binary counter having n-bits and adapted to count the number of high frequency pulses applied thereto from said high frequency pulse generating means, a first decoding means for converting binary-coded pulses, that have been fed thereto from said first binary counter, into $2^n$-radix coded pulses, means for detecting depression of one or more of said keys, said detecting means including a plurality of logical gating elements corresponding in number to the number of said keys and each having a pair of input terminals respectively connected to a corresponding one of output lines of said decoding means and a corresonding one of said key switches, a second binary counter having n-bits and adapted to count the number of output pulses emerging from said detecting means each time said depressed keys and pulses on output lines of said first deciding means coincide with each other, a second decoding means for converting binary-coded pulses, that have been fed thereto from said second binary counter, into $2^n$-radix coded pulses, means for causing said first binary counter to cease its counting operation by providing a barrier to passage of said high frequency pulses from said high frequency pulse generating means therethrough when pulses from output terminals of said second decoding means and said selection signal coincide to each other, a plurality of separate switching means corresponding in number to the number of said tone sources, each switching means coupled to a corresponding tone generator and a corresponding key depression detecting means and operable to permit passage of a tone signal therethrough from the associated tone source when said first binary counter ceases its counting operation thereby permitting said first decoding means to hold a pulse on a corresponding one of the output lines of said first decoding means, means coupled between said rhythm pulse generating means and said second binary counter for resetting the latter to perform its counting operation until one of the depressed keys which is designated by said selection signal and a pulse on one of the output lines of said first decoding means coincide with each other, and means for generating a bass to be sounded and coupled to said switching means, said bass being sounded on the basis of the tone signals received from said tone sources.

9. An automatic accompaniment system as claimed in claim 6, wherein said first and second binary counter and said first and second decoding means are constituted by a ring counter.

* * * * *